United States Patent [19]

Fenninger et al.

[11] Patent Number: 4,458,364

[45] Date of Patent: Jul. 10, 1984

[54] DISPOSABLE TOWEL, PARTICULARLY FOR HAIRDRESSING SALONS, BEAUTY PARLORS OR THE LIKE

[76] Inventors: Liane Fenninger; Simon Mosur, both of 4, rue de la Zinsel, 67300 Schiltigheim, France

[21] Appl. No.: 396,619

[22] Filed: Jul. 7, 1982

[30] Foreign Application Priority Data

Jul. 7, 1981 [FR] France ..... 81 13463

[51] Int. Cl.[3] ..... A41D 3/00

[52] U.S. Cl. ..... 2/50; 428/351

[58] Field of Search ..... 2/49–50, 2/48; 428/80, 351

[56] References Cited

U.S. PATENT DOCUMENTS

| | | | |
|---|---|---|---|
| 1,660,124 | 2/1928 | Grom | 2/50 |
| 2,378,380 | 6/1945 | Brown | 2/50 |
| 3,619,816 | 11/1971 | Cowen | 2/49 R |
| 3,629,865 | 12/1971 | Weiner | 2/48 |
| 3,879,762 | 4/1975 | Herman | 2/48 |
| 3,979,776 | 9/1976 | Gruenwald | 2/49 R |

FOREIGN PATENT DOCUMENTS

| | | | |
|---|---|---|---|
| 1561262 | 2/1969 | France . | |
| 3787833 | 6/1959 | Luxembourg . | |
| 603350 | 6/1948 | United Kingdom | 428/131 |
| 2091083 | 7/1982 | United Kingdom | 2/49 R |

*Primary Examiner*—Epstein, Henry F.

*Attorney, Agent, or Firm*—Young & Thompson

[57] ABSTRACT

A disposable towel, particularly for hairdressing salons, beauty shops or the like, is comprised by a support (1) of synthetic material bearing an intermediate layer (2) of defibered cellulose, and a non-woven layer (3) covering the intermediate layer (2) and secured with the latter to the support (1), by gluing, sealing or otherwise. On one side of the cut-out (4) for the neck of the wearer, there are provided tabs (5) for detachable securement to the other side of the towel. A small pocket (6) for a paper napkin (7) is provided at the upper part of the towel near an edge thereof. Another pocket (8) extends transversely of the midportion of the bottom of the towel, to receive cut hair, and has lateral internal compartments (9) for carrying barber's and beautician's implements. This latter pocket (8) may be folded against the support (1) and secured to the latter.

1 Claim, 1 Drawing Figure

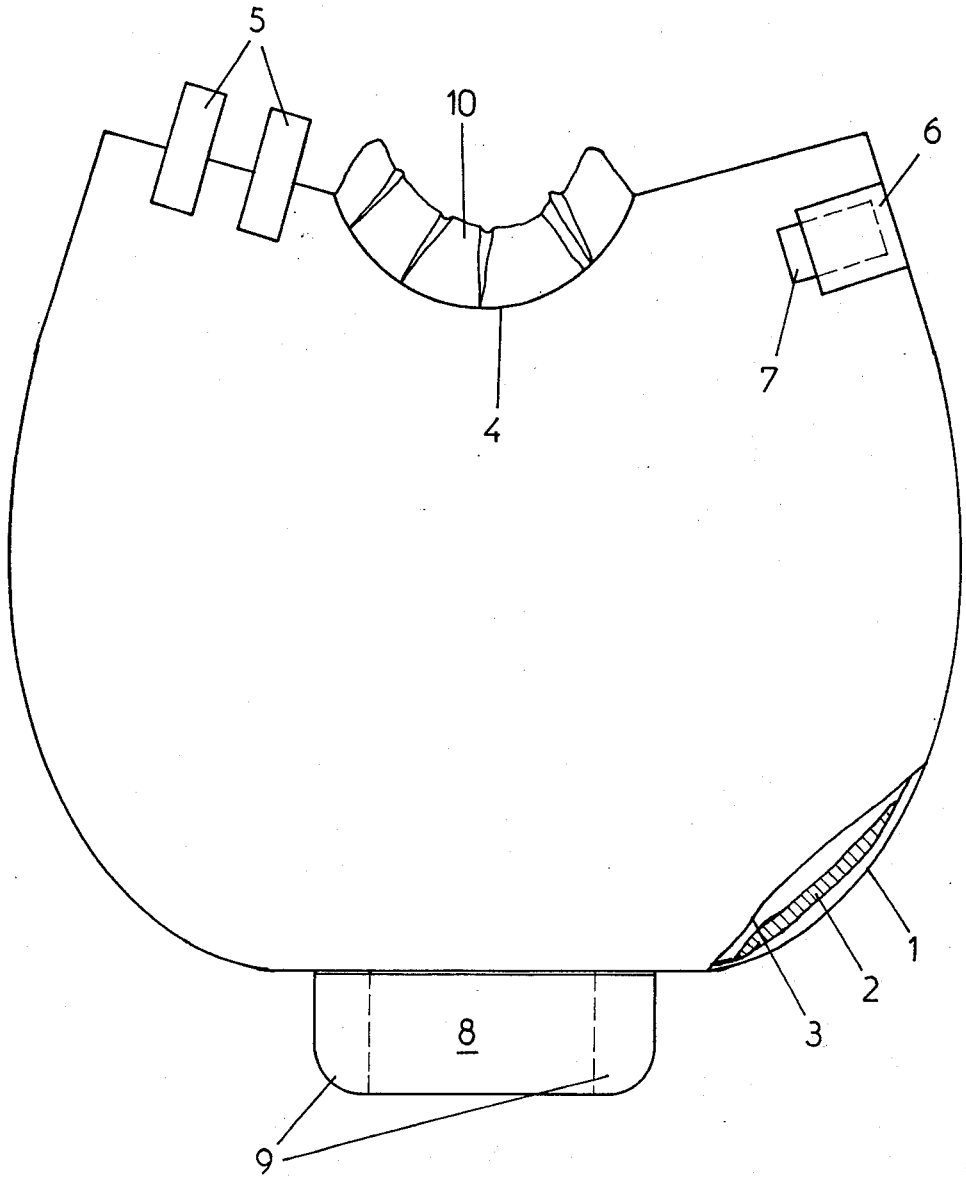
5
10
6
7
4
1
2
3
8
9

DISPOSABLE TOWEL, PARTICULARLY FOR HAIRDRESSING SALONS, BEAUTY PARLORS OR THE LIKE

The present invention relates to the field of accessories for hairdressing salons, beauty parlors, or the like, particularly protective towels and bibs, and has for its object a disposable towel useful for this purpose.

At present, to protect the clothing of customers during haircutting, there is generally used in hairdressing salons bibs with or without sleeves closed at the back of the customer and towels for drying the hair after shampooing and for protection of the bib and clothing against the products that are used.

These known towels and bibs provide fairly good protection, but the towels can ordinarily be used only one time because of hygienic reasons and must then be washed, and do not permit collection of the cut hairs, which must be separately collected. The bibs may be used several times, but also do not permit collection of the hair. Moreover, in view of the increasingly frequent prewashing of hair, the bibs are often damp after cutting and must be subjected to drying. For this reason, a large number of towels and bibs are necessary, which represents a fairly high investment, and high costs for washing, particularly the bibs.

The present invention has for its object to overcome these difficulties.

Thus, it has for its object a disposable towel, particularly for hairdressing salons, beauty shops, or the like, characterized in that it is constituted essentially by a support of synthetic material carrying an intermediate layer of defibered (ground) cellulose, and by a non-woven material covering the intermediate layer and secured with the latter on the support, by gluing, sealing or the like, in that it is provided on one side of the neck recess with one or more tabs for securement to the other side, in that it is provided, in its upper portion near one edge, with a pocket enclosing a paper napkin, and in that it is provided in its lower portion with a pocket extending transversely of the midportion, adapted for the reception of cut hair, and having lateral internal compartments adapted to receive the tools needed by a barber or a beautician.

The invention will be better understood thanks to the following description, which relates to a preferred embodiment, given by way of non-limiting example, and explained with reference to the annexed schematic drawing, whose sole FIGURE is a plan view, partially in cross section, of a bib according to the invention.

The disposable towel, particularly for hairdressing salons, beauty parlors, or the like, is constituted by a support 1 of synthetic material having an intermediate layer 2 of defibered cellulose, and by a non-woven layer 3 covering the layer 2 and secured with the latter on support 1 by cementing, sealing, or otherwise. On one side of the neck recess 4, the towel is provided with tabs 5 for securement to the other side, and near one edge it is provided with a small pocket 6 enclosing a paper napkin 7 adapted to sop up small quantities of water from various sources. In its lower portion, transversely of its midportion, the towel is provided with a pocket 8 having lateral compartments 9 that may be folded against the support 1 and secured to the latter. This pocket 8 may advantageously serve for the collection of cut hairs whereby the separate collection of the latter is avoided, and the lateral compartments 9 may serve to house the tools necessary to the barber during haircutting, or else, together with the pocket 8, carrying the products and tools used in a beauty salon.

The towel according to the invention permits, thanks to the intermediate layer 2, a good absorption of moisture while at the same time protecting the client against the latter thanks to the synthetic material support 1. Moreover, the non-woven layer 3 permits the passage of moisture, does not leave fibers on the combs, brushes or the like, and resists wear by these tools. Moreover, thanks to the pocket 8 the cut hairs may be directly recovered without the need for sweeping them up, and the compartments 9 for housing barber tools permit the barber to avoid constant trips to an adjoining work table to pick up and put down the tools, these being quite near to hand.

Finally, after use, it suffices to release the tabs 5 to take the towel off the customer, which towel is then folded and thrown away, the next customer being provided with a fresh towel. Thus, the cost of washing towels and bibs is avoided and hygiene is ensured.

According to another characteristic of the invention, the neck cut-out 4 is preferably provided with a collar 10 constituted by a band of material like that of support 1 and by a band of non-woven material, this collar 10 being adapted to be engaged about the neck of the client and to collect the residues of moisture running down the nape of the neck.

Of course, the invention is not limited to the embodiment described and shown in the accompanying drawing. Modifications remain possible, particularly with respect to the construction of the various elements, or by substitution of equivalent techniques, without thus departing from the scope of protection of the invention.

What is claimed is:

1. A disposable towel for barbers and beauticians and the like, comprising a support (1) of synthetic moisture-resistant material carrying an intermediate layer (2) of moisture-absorbent cellulose material, a non-woven layer (3) covering the intermediate layer (2) and secured with the latter to the support (1), the towel having a neck cut-out (4), at least one adhesive tab (5) on one side of the neck cut-out (4) for adhesive securement to the other side thereof, a small pocket (6) for holding a paper napkin, the pocket (6) being secured to an upper part of the towel adjacent an edge thereof, another pocket (8) extending transversely of the midportion of the lower edge of the towel for the reception of cut hair, said another pocket (8) having lateral internal compartments (9) on opposite sides thereof for carrying barber's or beautician's tools, and a collar (10) bordering the neck cut-out (4), the collar being comprised by a band of the same material as that of the support (1) and by a band of non-woven fabric, whereby said collar (10) is adapted to contact the neck of the user and to collect moisture therefrom.

* * * * *